US010366663B2

(12) United States Patent
Shepelev

(10) Patent No.: US 10,366,663 B2
(45) Date of Patent: Jul. 30, 2019

(54) DITHERING A CLOCK USED TO UPDATE A DISPLAY TO MITIGATE DISPLAY ARTIFACTS

(71) Applicant: SYNAPTICS INCORPORATED, San Jose, CA (US)

(72) Inventor: Petr Shepelev, Campbell, CA (US)

(73) Assignee: SYNAPTICS INCORPORATED, San Jose, CA (US)

( * ) Notice: Subject to any disclaimer, the term of this patent is extended or adjusted under 35 U.S.C. 154(b) by 419 days.

(21) Appl. No.: 15/185,064

(22) Filed: Jun. 17, 2016

(65) Prior Publication Data

US 2017/0243550 A1 Aug. 24, 2017

Related U.S. Application Data

(60) Provisional application No. 62/296,778, filed on Feb. 18, 2016.

(51) Int. Cl.

| | |
|---|---|
| ***G09G 3/36*** | (2006.01) |
| ***G09G 3/20*** | (2006.01) |
| ***G09G 5/00*** | (2006.01) |

(52) U.S. Cl.

CPC ..... *G09G 3/3607* (2013.01); *G09G 3/2003* (2013.01); *G09G 3/3611* (2013.01); *G09G 5/008* (2013.01); *G09G 2300/0452* (2013.01); *G09G 2310/061* (2013.01); *G09G 2310/08* (2013.01); *G09G 2320/0233* (2013.01); *G09G 2320/0242* (2013.01); *G09G 2320/0247* (2013.01); *G09G 2320/0257* (2013.01)

(58) Field of Classification Search

CPC .. G09G 3/2003; G09G 3/3607; G09G 3/3611; G09G 5/008

See application file for complete search history.

(56) References Cited

U.S. PATENT DOCUMENTS

| | | | | |
|---|---|---|---|---|
| 4,654,704 | A | 3/1987 | Lippel | |
| 5,115,189 | A | 5/1992 | Holcomb | |
| 5,243,441 | A | 9/1993 | Kawata | |
| 7,425,939 | B2 | 9/2008 | Asano | |
| 7,802,118 | B1 * | 9/2010 | Abdalla | G06F 1/08 713/322 |
| 7,958,483 | B1 * | 6/2011 | Alben | G06F 1/3203 713/322 |
| 8,050,375 | B2 | 11/2011 | Staszewski et al. | |
| 8,068,573 | B1 | 11/2011 | Khlat et al. | |

(Continued)

*Primary Examiner* — Carolyn R Edwards

(74) *Attorney, Agent, or Firm* — Patterson + Sheridan, LLP

(57) ABSTRACT

A display device can use clock dithering to spread the frequency spectrum of the clock signal (and the signals derived therefrom) to mitigate interference with other components or systems in a host device. However, dithering the clock signal can introduce display artifacts into the display device. For example, lines or rows in the display may flicker, the brightness of display lines may be non-uniform, or color shifts in displayed pixels. To reduce display artifacts, the embodiments herein synchronize clock dithering to a display update event. That is, the display device varies a parameter of clock dithering so that the dithering is synchronized to the display update event. In another embodiment, the clock dithering is set according to the rate at which display lines or sub-pixels are updated. In another embodiment, clock dithering is synchronized to a display frame update period.

20 Claims, 7 Drawing Sheets

(56) References Cited

U.S. PATENT DOCUMENTS 8,134,411 B2 3/2012 Shi et al.
8,138,840 B2 3/2012 Ainspan et al.
8,768,278 B2 7/2014 Frank
8,769,332 B2 7/2014 Ziesler et al.
8,880,928 B2 11/2014 Remlin et al.
8,896,590 B2 * 11/2014 Yanagi ..... G09G 3/3677 345/213
2002/0118152 A1 * 8/2002 Nukiyama ..... G09G 3/3611 345/87
2004/0066363 A1 * 4/2004 Yamano ..... G09G 3/20 345/98
2005/0073516 A1 * 4/2005 Kang ..... G09G 3/2014 345/204
2006/0170775 A1 * 8/2006 Kim ..... G09G 3/006 348/181
2007/0002036 A1 * 1/2007 Kardach ..... G09G 5/006 345/213
2010/0253672 A1 * 10/2010 Ota ..... G09G 3/3611 345/213
2012/0099159 A1 * 4/2012 Keithley ..... H04N 1/00994 358/406
2012/0127133 A1 * 5/2012 Frank ..... H04B 15/06 345/204
2013/0038791 A1 * 2/2013 Tripathi ..... G09G 5/395 348/500
2013/0191677 A1 * 7/2013 Ziesler ..... G06F 1/3237 713/500
2016/0195988 A1 * 7/2016 Fu ..... G06F 3/044 345/174

* cited by examiner

DITHERING A CLOCK USED TO UPDATE A DISPLAY TO MITIGATE DISPLAY ARTIFACTS

CROSS-REFERENCE TO RELATED APPLICATIONS

This application claims benefit of U.S. provisional patent application Ser. No. 62/296,778, filed Feb. 18, 2016 which is herein incorporated by reference.

FIELD OF THE INVENTION

This invention generally relates to electronic devices, and more specifically, to dithering a clock signal used when updating a display.

BACKGROUND OF THE INVENTION

Display devices are used in many types of computing devices such as laptops, desktops, mobile phones, tablets, and the like. Generally, a display device includes a display screen defined by rows of pixels. Moreover, each pixel may include a plurality of sub-pixels (e.g., red, green, and blue) whose outputs combine to generate the color of the pixel.

To update the pixels in a liquid crystal display, the display device can include gate lines (or row select lines) that permit the device to access pixels along each row. The device also includes source lines (or data lines) which drive voltages across liquid crystal material that determine the color of the sub-pixels, and thus, the color of the pixels.

BRIEF SUMMARY OF THE INVENTION

One embodiment described herein is a processing system for a display device, the processing system includes a clock generator configured to generate a clock signal using clock dithering for updating a display of the display device, wherein the processing system is configured to vary a parameter of the clock dithering performed on the clock signal in response to a display event.

Another embodiment disclosed herein is an input device. The input device includes a display comprising a plurality of display lines and a processing system coupled to the display, the processing system comprising a clock generator configured to generate a clock signal using clock dithering for updating the display, where the processing system is configured to vary a parameter of the clock dithering performed on the clock signal in response to a display event.

Another embodiment disclosed herein is a method of operating a display device. The method includes generating a dithered clock signal used for updating a display in the display device and varying a parameter of the dithered clock signal in response to a display event.

BRIEF DESCRIPTION OF DRAWINGS

The preferred exemplary embodiment of the present invention will hereinafter be described in conjunction with the appended drawings, where like designations denote like elements, and.

Figure 1:
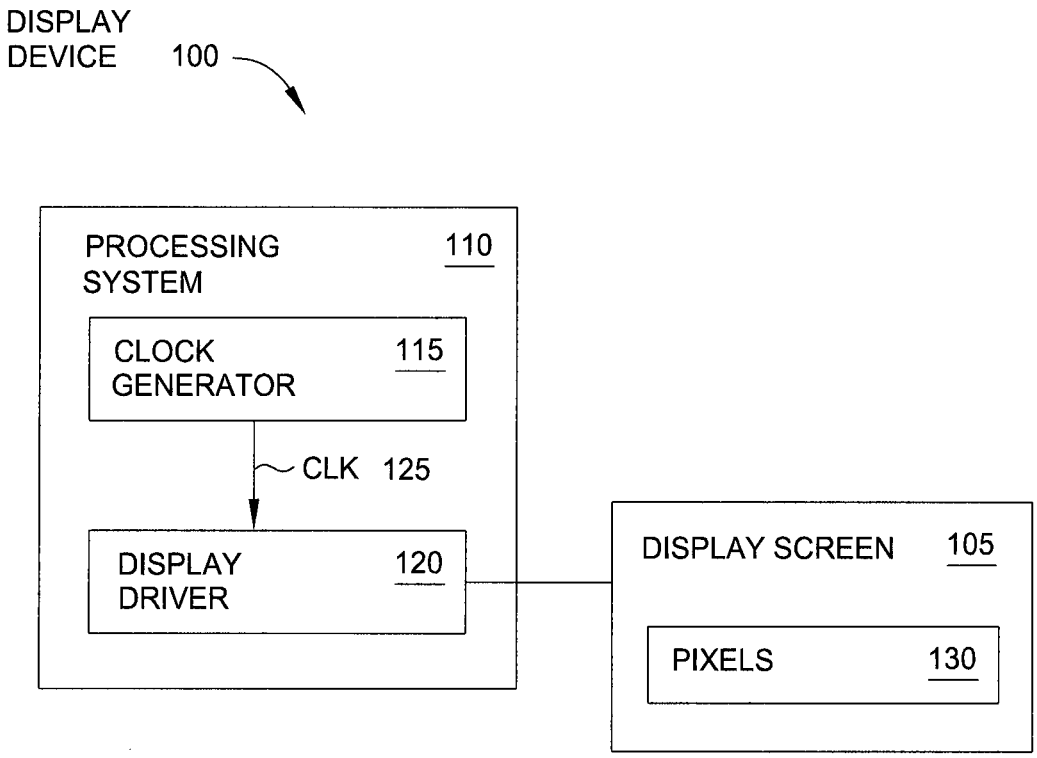
FIG. 1 is a block diagram of a display device that includes a processing system in accordance with an embodiment of the invention.

To facilitate understanding, identical reference numerals have been used, where possible, to designate identical elements that are common to the figures. It is contemplated that elements disclosed in one embodiment may be beneficially utilized on other embodiments without specific recitation. The drawings referred to here should not be understood as being drawn to scale unless specifically noted. Also, the drawings are often simplified and details or components omitted for clarity of presentation and explanation. The drawings and discussion serve to explain principles discussed below, where like designations denote like elements.

DETAILED DESCRIPTION

The following detailed description is merely exemplary in nature and is not intended to limit the invention or the application and uses of the invention. Furthermore, there is no intention to be bound by any expressed or implied theory presented in the preceding technical field, background, brief summary or the following detailed description.

A display device includes a plurality of pixels that are updated during frame update periods. To do so, the display device generates a clock signal that controls gate lines and source lines used to select and update the pixels. This clock signal (and the signals derived from the clock signal), however, can interfere with other components and systems in the display device. For example, the clock signal can interfere with an RF antenna if the display device is integrated into a mobile phone.

In one embodiment, the display device uses clock dithering to spread the frequency spectrum of the clock signal (and the signals derived therefrom) to mitigate interference with other components or systems in a host device. Generally, dithering the clock signal means changing its duty cycle which increases and/or decreases the frequency of the clock and its derived signals. However, dithering the clock signal can introduce display artifacts into the display device. For example, lines or rows in the display may flicker, the brightness of display lines may be non-uniform, or color shifts in displayed pixels. One reason for these display artifacts is a variation in the duration of time the display devices drives a source line from frame-to-frame, line-to-line, and/or color-to-color.

To reduce display artifacts, the embodiments herein synchronize clock dithering to a display update event. That is, the display device varies a parameter of clock dithering so that the dithering is synchronized to a display update event. In one embodiment, clock dithering is synchronized to a pixel update period. The clock frequency during the pixel update period may change; however, the change in frequency is the same for each of the pixel update periods. Stated differently, clock dithering resets during each pixel update period so that the same clock dithering is performed during each pixel update period. Thus, the change in voltage on the pixels caused by dithering is uniform across all the pixels thereby preventing the display artifacts described above. The pixel update period may be the number of clock cycles used to update individual sub-pixels in a pixel (e.g., red, green, or blue) if updated sequentially or the number of clock cycles used to update each display line if the sub-pixels are updated in parallel.

In another embodiment, the clock dithering is set according to the rate at which display lines or sub-pixels are updated. In one embodiment, the frequency of the clock is set to an integer multiple of the update rate of the display lines if the sub-pixels in each pixel are updated in parallel. Alternatively, the frequency of the clock is set to an integer multiple of the update rate of the sub-pixels if each sub-pixel is updated sequentially. Moreover, the rate at which the display lines are updated may change during certain display events—e.g., at the beginning of a display frame or after a blanking period. In response to a change in the display line update rate or the sub-pixel update rate, the display device also changes the clock frequency to maintain the same integer multiple relationship and achieve clock dithering.

In another embodiment, clock dithering is synchronized to a display frame update period. In one example, the frequency of the clock may change in the same manner during each display frame. As a result, any voltage change in the display lines is gradual and is imperceptible to the user. Alternatively, the change in the clock frequency may be different for different display frames. For example, in a first display frame, the clock frequency may gradually increase from a low frequency to a high frequency, but during a second display frame, the clock frequency decreases from a high frequency to a low frequency. Any difference of brightness of the display lines in the two frames is averaged by the human eye, and thus, does not result in a display artifact.

Turning now to the figures, FIG. 1 is a block diagram of an exemplary display device 100, in accordance with embodiments of the invention. The input device 100 may be configured to provide displayed images for an electronic system (not shown). As used in this document, the term "electronic system" (or "electronic device") broadly refers to any system capable of electronically processing information. Some non-limiting examples of electronic systems include personal computers of all sizes and shapes, such as desktop computers, laptop computers, netbook computers, tablets, web browsers, e-book readers, and personal digital assistants (PDAs). Other examples include remote terminals, kiosks, and video game machines (e.g., video game consoles, portable gaming devices, and the like). Other examples include communication devices (including cellular phones, such as smart phones), and media devices (including recorders, editors, and players such as televisions, set-top boxes, music players, digital photo frames, and digital cameras). Additionally, the electronic system could be a host or a slave to the display device 100.

The display device 100 can be implemented as a physical part of the electronic system, or can be physically separate from the electronic system. As appropriate, the display device 100 may communicate with parts of the electronic system using any one or more of the following: buses, networks, and other wired or wireless interconnections. Examples include $I^2C$, SPI, PS/2, Universal Serial Bus (USB), Bluetooth, RF, and IRDA.

In FIG. 1, the display device 100 includes a processing system 110 coupled to a display screen 105. The processing system 110 is configured to operate the hardware of the display device 100 to display images in the display screen 105. The processing system 110 comprises parts of or all of one or more integrated circuits (ICs) and/or other circuitry components. In some embodiments, the processing system 110 also comprises electronically-readable instructions, such as firmware code, software code, and/or the like. In some embodiments, components composing the processing system 110 are located together, such as near the display screen 105. In other embodiments, components of processing system 110 are physically separate with one or more components close to the display screen 105, and one or more components elsewhere. For example, the display device 100 may be a peripheral coupled to a desktop computer, and the processing system 110 may comprise software configured to run on a central processing unit of the desktop computer and one or more ICs (perhaps with associated firmware) separate from the central processing unit. As another example, the display device 100 may be physically integrated in a phone, and the processing system 110 may comprise circuits and firmware that are part of a main processor of the phone. In some embodiments, the processing system 110 is dedicated to implementing the display device 100. In other embodiments, the processing system 110 also performs other functions, such as performing capacitive sensing, driving haptic actuators, etc.

The processing system 110 may be implemented as a set of modules that handle different functions of the processing system 110. Each module may comprise circuitry that is a part of the processing system 110, firmware, software, or a combination thereof. In various embodiments, different combinations of modules may be used. Example modules include hardware operation modules for operating hardware such display screen 105, data processing modules for processing data such as display frame updates, and reporting modules for reporting information.

As shown, the processing system 110 includes a clock generator 115 which outputs a clock signal (CLK) 125 and a display driver 120. Although not shown, the clock generator 115 may receive a reference clock from another component in the processing system 110 or from a separate component in the electronic device (e.g., a host CPU) in order to generate the CLK 125. As described below, the clock generator 115 changes the frequency of the CLK 125 to perform dithering which mitigates the likelihood the CLK 125 (and signals derived therefrom) interferes with other signals and systems in the display device 100.

The display driver 120 may include gate line drivers and source line drivers. The gate line drivers are coupled to gate lines in the display screen 105 which select different rows in the pixels 130. The source line drivers, in contrast, couple to source lines in the display screen 105 which set the voltages across the pixels 130 (if the display screen 105 is a liquid crystal display). In operation, the gate line drivers select one of the rows of pixels 130 in the display screen 105 while the other rows are deactivated. The source line drivers then drive voltages on all the pixels 130 in the selected row to set the color of the pixels. The gate line drivers then select a different row and the process repeats until all the rows in the screen 105 have been updated—i.e., a frame update. When a new display frame is received, the display driver 120 again rasters through the rows (either in order or out of order) to update the pixels 130.

In some embodiments, the display device 100 comprises a touch screen interface where a sensing region overlaps at least part of an active area of the display screen 105. For example, the display device 100 may comprise substantially transparent sensor electrodes overlaying the display screen 105 and provide a touch screen interface for the associated electronic system. The display screen 105 may be any type of dynamic display capable of displaying a visual interface to a user, and may include any type of light emitting diode (LED), organic LED (OLED), cathode ray tube (CRT), liquid crystal display (LCD), plasma, electroluminescence (EL), or other display technology. In one embodiment, capacitive sensing may utilize some of the same electrical components for updating the display screen 105. As another example, the touch screen interface may be operated in part or in total by the processing system 110.

It should be understood that while many embodiments of the invention are described in the context of a fully functioning apparatus, the mechanisms of the present invention are capable of being distributed as a program product (e.g., software) in a variety of forms. For example, the mechanisms of the present invention may be implemented and distributed as a software program on information bearing media that are readable by electronic processors (e.g., non-transitory computer-readable and/or recordable/writable information bearing media readable by the processing system 110). Additionally, the embodiments of the present invention apply equally regardless of the particular type of medium used to carry out the distribution. Examples of non-transitory, electronically readable media include various discs, memory sticks, memory cards, memory modules, and the like. Electronically readable media may be based on flash, optical, magnetic, holographic, or any other storage technology.

Figure 2A:
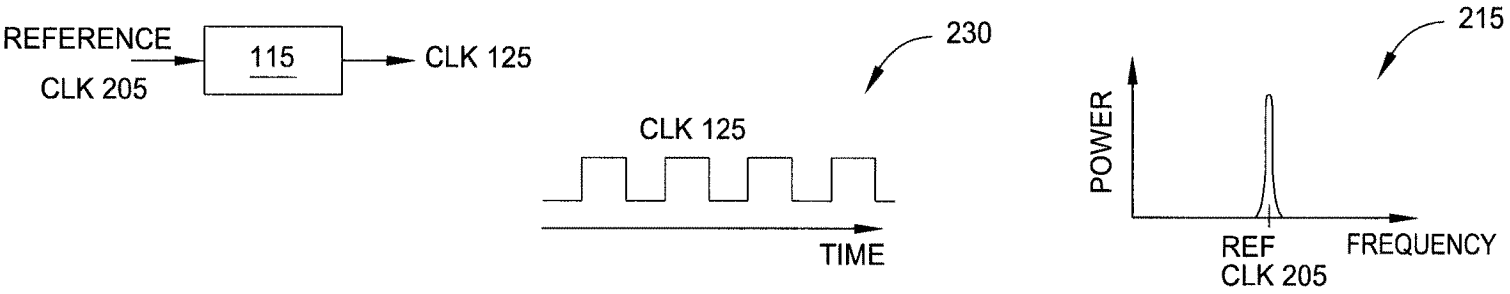
FIG. 2A illustrates using a clock in a display device without dithering accordance with an embodiment of the invention.

FIG. 2A illustrates using a clock in a display device without dithering in accordance with an embodiment of the invention. As shown in FIG. 2A, the clock generator 155 receives a reference CLK 205 as an input and outputs the CLK 125. In one embodiment, the reference CLK 205 may be generated by a host CPU or a clock oscillator. Using the reference CLK 205, the clock generator 115 generates the CLK 125 which is used to drive at least one display element—e.g., a display driver—when updating a display screen.

FIG. 2A also illustrates a timing diagram 230 of the CLK 125. In this example, the CLK 125 is a square wave with a 50% duty cycle. That is, the CLK 125 is at a high voltage the same amount of time it is at a low voltage. Moreover, the CLK 125 has a fixed frequency, and thus, the duty cycle does not change over time. Although a square wave is shown, the CLK 125 may be a different type of modulated signal—e.g., a sine wave or sawtooth.

Chart 215 illustrates the frequency spectrum of the CLK 125. As shown, most of the power in the CLK 125 is concentrated at the frequency of the reference CLK 205. Because of this high concentration of power, the CLK 125 may interfere with other components in the electronic device such as the wireless transmitters, wireless receivers, and the like which operates at the same frequency. Put differently, the traces carrying the CLK 125 may act like antennas which emit RF radiation which can interfere with separate wireless communication systems in the electronic device.

Figure 2B:
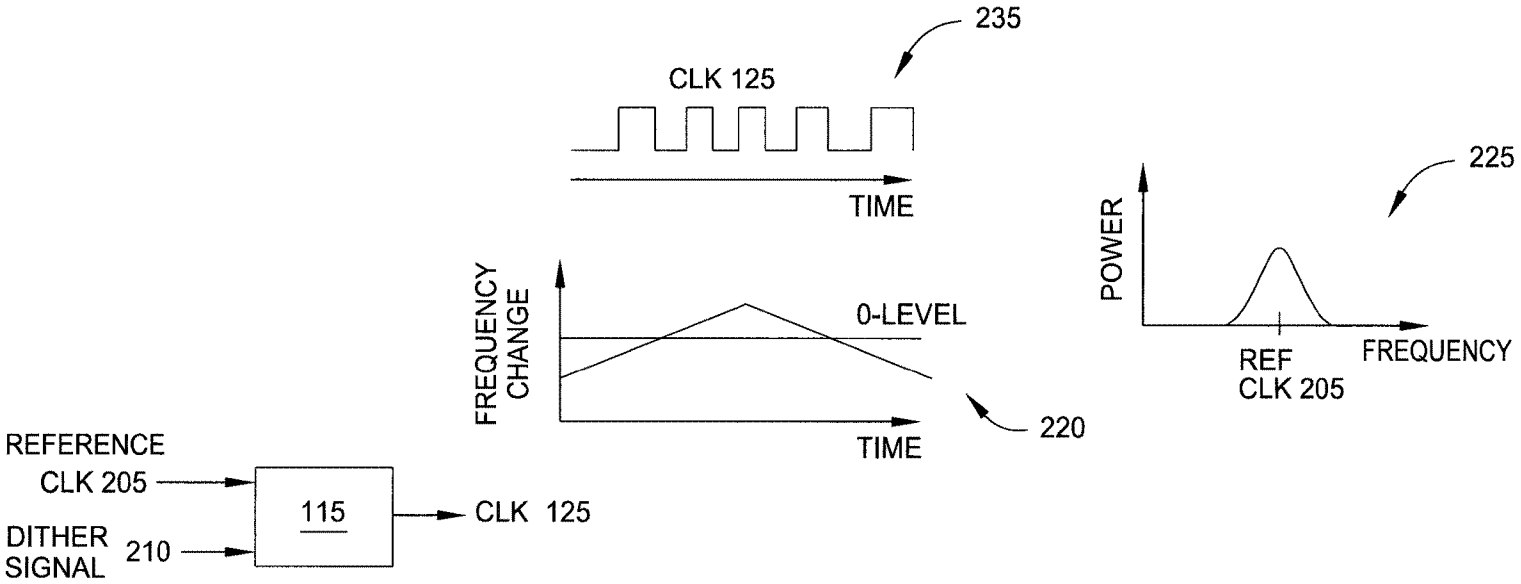
FIG. 2B illustrates using a clock in a display device with dithering accordance with an embodiment of the invention.

FIG. 2B illustrates using a clock in a display device with dithering accordance with an embodiment of the invention to mitigate or prevent the CLK 125 from interfering with other systems in the display device. In addition to receiving the reference CLK 205, the clock generator 115 receives a dither signal 210 which controls how the clock generator 115 changes the frequency of the output CLK signal 125. Unlike in FIG. 2A, timing diagram 235 illustrates that the duty cycle, and thus the frequency, of CLK 125 varies over time. This is further illustrated in chart 220 where the frequency of the CLK 125 begins at a frequency below the average (0-level) frequency, increases to a frequency greater than the average frequency, and then decreases to the original frequency. Although the CLK 125 changes, the number of transitions in the CLK 125 are the same as if the CLK 125 was held constant at the average 0-level frequency.

Chart 225 illustrates the frequency spectrum of the dithered CLK 125. Unlike in chart 215, the power transmitted by CLK 125 is spread out over a larger range of frequencies. As a result, any radiation emitted by the traces carrying the CLK 125 has less power and is less likely to interfere with other systems in the electronic device. For example, if a wireless receiver receives data signals at frequencies near the frequency of the reference CLK 205, dithering the CLK 125 as shown in FIG. 2B reduces the amount of RF radiation emitted by the display device relative to not dithering the CLK 125 as shown in FIG. 2A.

Figure 3:
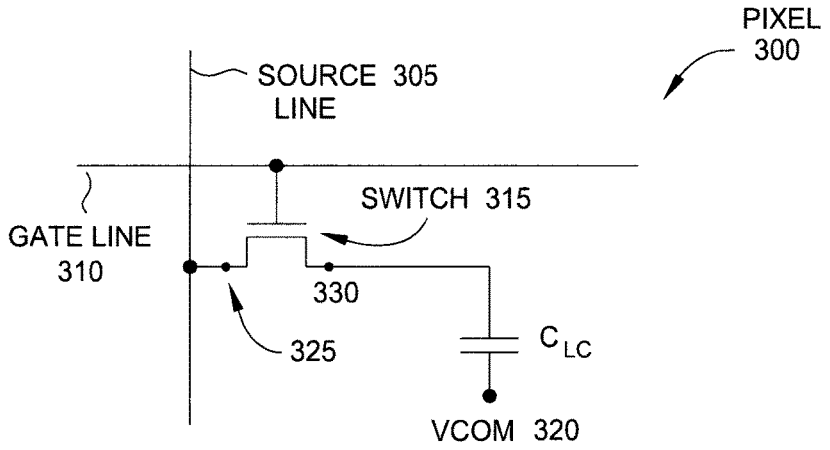
FIG. 3 is a liquid crystal pixel in a display device in accordance with an embodiment of the invention.

FIG. 3 is a liquid crystal pixel 300 in a display device in accordance with an embodiment of the invention. The pixel 300 includes a source line 305 extending in a direction normal to a gate line 310. The gate line 310 couples to a gate of a switch 315 (e.g., a transistor) which activates and deactivates the switch 315—i.e., controls whether current flows between nodes 325 and 330. The source line 305 is coupled to node 325 while node 330 is coupled to a first side of a capacitance $C_{LC}$ formed by the liquid crystal material.

When the gate line 310 activates the switch 315, the source line 305 is electrically coupled to capacitance $C_{LC}$ which permits the source line 305 to drive a voltage across the liquid crystal material (relative to a common voltage VCOM), thereby setting the color of the pixel 300. That is, changing the voltage across the capacitance $C_{LC}$ changes a property of the liquid crystal material which alters the color of the pixel 300.

In one embodiment, the pixel 300 may include a plurality of sub-pixels. For example, each pixel in the display screen may include three individual sub-pixels—e.g., a red sub-pixel, green sub-pixel, and blue sub-pixel. The total color of the pixel 300 depends on the specific brightness or illumination of the sub-pixels. For example, to display a purple pixel 300, the red and blue sub-pixels are brightly illuminated while the green-sub-pixel is not. To the perspective of the user, the right and blue light of the sub-pixels merge to form purple. Furthermore, the source line 305 may be used to update the voltage on the various sub-pixels. Although not shown, the pixel 300 may include a multiplexor that selectively couples the source line 305 to the liquid crystal material of each one of the sub-pixels. Thus, the display driver can use the same source line 305 to update the sub-pixels at three different time periods. Alternatively, the pixel may include three separate source lines 305—one for each sub-pixel—in which case the voltages across the sub-pixels can be updated in parallel. Although the embodiments herein use a red, green, blue (RGB) pixel as an example pixel, the techniques herein may be used with displays with different color schemes that have less or more colors than RGB.

Although the pixel 300 is for a liquid crystal display, the embodiments herein can be used with different types of display systems—e.g., LED, OLED, CRT, plasma, electroluminescence (EL), etc. For example, in OLED, the sub-pixels could be separate red, blue, and green emitters which output light based on control signals provided by data lines. In OLED, storage capacitors associated with OLED pixels are charged when the pixels are refreshed. The charging process takes time for the capacitors to reach to a saturation point. Dithering may shorten the charging time such that the capacitors do not reach the saturation point, and thus, the embodiments herein can be used to ensure the capacitors have sufficient time to charge.

Figure 4:
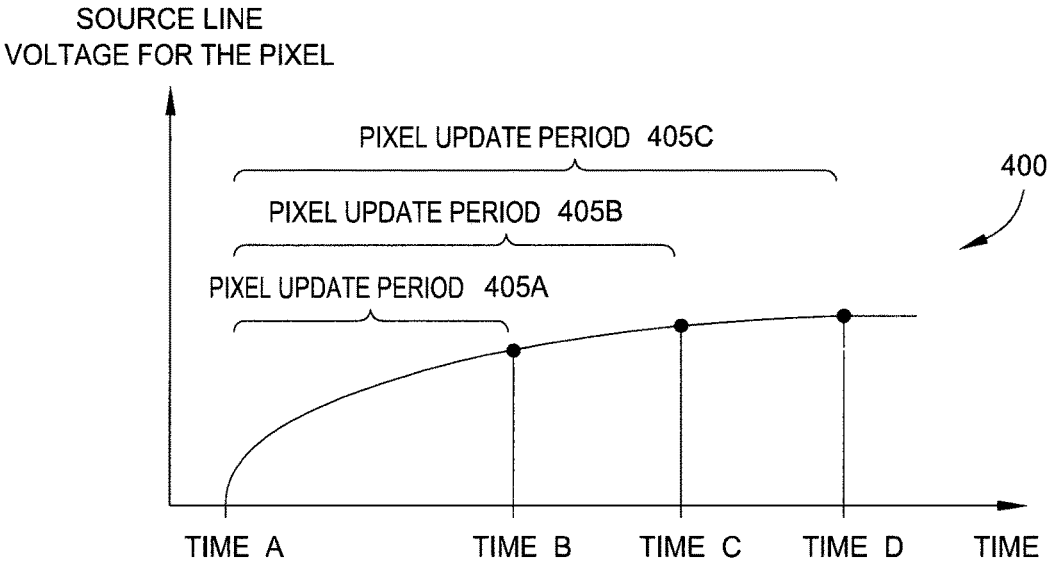
FIG. 4 is a chart illustrating the voltage change on a pixel due to dithering in accordance with an embodiment of the invention.

FIG. 4 is a chart 400 illustrating the change voltage on the pixel 300 in FIG. 3 due to dithering in accordance with an embodiment of the invention. As described above, dithering changes the frequency of the CLK signal used for performing display updating which directly alters the amount of voltage across the capacitive liquid crystal material as illustrated in chart 400. The Y-axis illustrates the voltage across the liquid crystal material of a pixel (or sub-pixel) while the X-axis is time. At Time A, the pixel update period begins and the source line begins to change the voltage across the liquid crystal material. Referring to FIG. 3, at Time A, the gate line 310 may activate the switch 315 which electrically couples the capacitance $C_{LC}$ to the source line 305. In this example, it is assumed that the voltage across the liquid crystal material before Time A is zero, but this is not a requirement.

Time B represents the time the pixel update period ends if a faster than average CLK signal is used by the display driver to perform display updating. That is, if dithering causes the CLK signal to have an average clock frequency faster than the reference CLK, then the pixel update period 405A ends at Time B. In contrast, Time C represents the time the pixel update period 405B ends if the CLK signal is not dithered, or if the average frequency of the CLK between Time A and Time C is the same as the frequency of the reference CLK. Finally, Time D represents the time when the pixel update period 405C ends if dithering the CLK signal results in an average CLK frequency that is slower than the reference CLK. In one embodiment, the number of cycles or transitions of the CLK signal in each of the pixel update periods 405A-C is the same but the overall length of the periods 405A-C are different because of the different average frequencies of the CLK signal due to dithering.

Comparing the voltages at Times B, C, and D illustrates one problem of dithering where different voltages are driven across the pixel or sub-pixels which can unintentionally change the color of the pixel. For example, if when updating a red sub-pixel the CLK is slower as shown by pixel update period 405C, then the voltage on the red sub-pixel may be higher than intended, thereby changing the sub-pixels' brightness and the overall color of the pixel. Moreover, when updating the same red sub-pixel during the subsequent display frame, dithering the CLK signal may cause a shorter pixel update period (e.g., period 405A). Thus, even if the pixel color should not change during the two frames, because dithering can change the brightness of the red sub-pixel, the user may perceive an unintended color shift or flicker in the pixel. Other examples of display artifacts introduced because of dithering include flickering of lines and/or non-uniform brightness of display lines where the average CLK frequency may change when updating display lines in the same frame.

Figure 5:
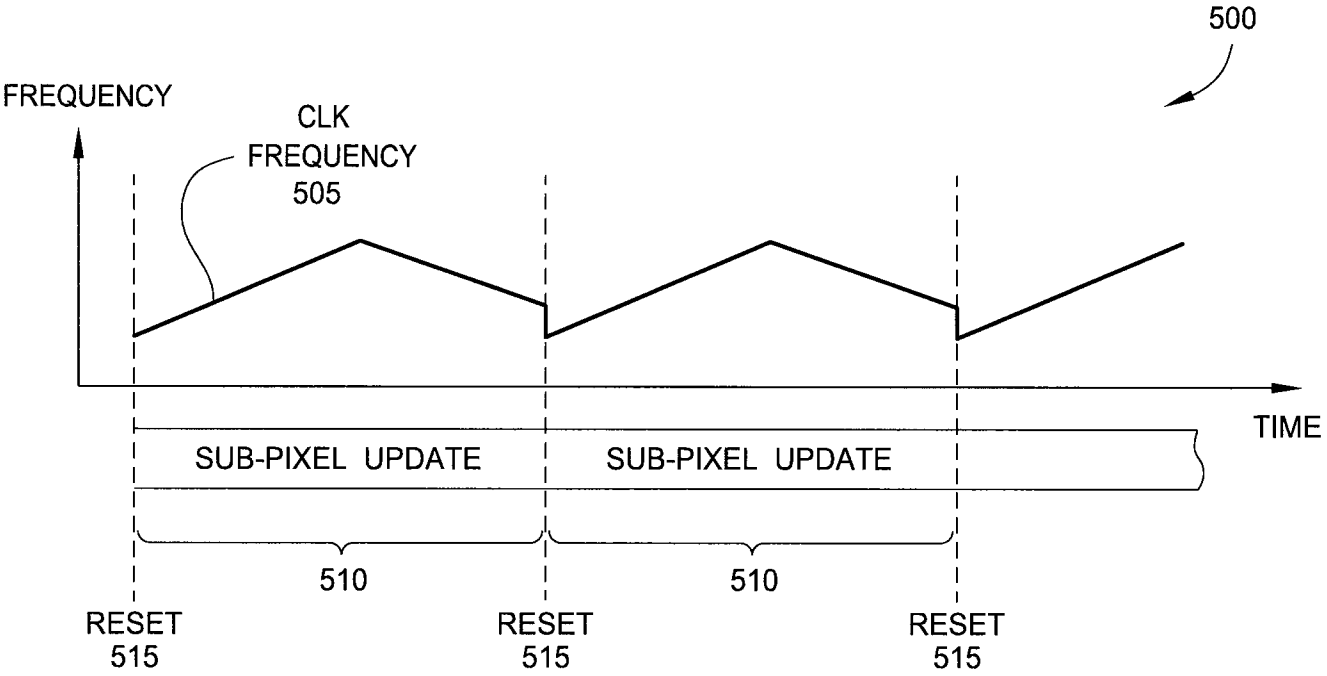
FIG. 5 is chart that illustrates synchronizing dithering with a pixel refresh period in accordance with an embodiment of the invention.

FIG. 5 is chart 500 illustrating synchronizing dithering with a pixel refresh period in accordance with an embodiment of the invention. In chart 500, clock dithering is controlled to result in sub-pixel refresh periods 510 with constant lengths. That is, the average frequency of the CLK signal in each of the sub-pixel update periods 510 is the same, although the instantaneous frequency 505 of the CLK changes. Because the average frequency of the CLK for each period 510 (and the duration of each period 510) is the same, the brightness of the sub-pixels does not unintentionally change between display frames. That is, because dithering the CLK as shown in chart 500 does not change the time period of a particular sub-pixel between sequential frames, then the same voltage is driven across the sub-pixel during sequential frames resulting in the same brightness (assuming the brightness of the sub-pixel should remain constant in the frames).

In chart 500, the pattern of changing the CLK frequency 505 during each of the sub-pixel update periods 510 is the same. That is, at the beginning of each sub-pixel update period 510, the dithering pattern is reset (i.e., the CLK frequency 505 is changed to a predetermined frequency) and a parameter controlling the dithering of the CLK (e.g., the dithering signal 210 in FIG. 2B) ensures the CLK frequency 505 changes in the same manner for each of the periods 510. As a result, the CLK frequency 505 follows the same pattern in each of the update periods 510 which results in the same average CLK frequency 505 and the same duration for the sub-pixel update periods 510.

Although chart 500 illustrates changing the CLK frequency 505 in the same manner during each sub-pixel update period 510, this is not a requirement. The change in the CLK frequency 505 during the first sub-pixel update period 510 may be different than how the CLK frequency 505 changes during the second sub-pixel update period 510. For example, instead of the CLK frequency 505 increasing and then decreasing during an update period 510, during one of the periods 510 the CLK frequency may start at a higher frequency, decrease to a lower frequency, and then increase again to the higher frequency. If the average frequency of the CLK during the time periods 510 is the same, then the duration of the periods 510 is also the same. Thus, the same benefit is achieved where the brightness of the sub-pixels does not vary between display frames because of dithering. Put differently, the manner in which the CLK frequency 505 changes during the periods 510 does not matter so long as the average CLK frequency over the number of clock cycles required to perform each of the sub-pixel update periods 510 remains constant. Doing so ensures the duration of the periods 510 is the same and prevents fluctuations in the brightness of the sub-pixels due to dithering between sequential frames.

In one embodiment, instead of being sub-pixel updates 510, chart 500 can illustrate a plurality of sequential display line updates. In this example, instead of using different sub-pixel updates 510 to update the different sub-pixels (e.g., red, green, or blue) in a pixel, the display device updates each of the sub-pixels in parallel. That is, the display device may include respective source lines coupled to each sub-pixel in the display line so each sub-pixel can be updated in parallel rather than sequentially. Like above, so long as the average frequency of the CLK during the display line update is the same, then the duration of the display line updates are also the same and the brightness of the display lines relative to each other is not affected by dithering the CLK during the update periods.

Figure 6A:
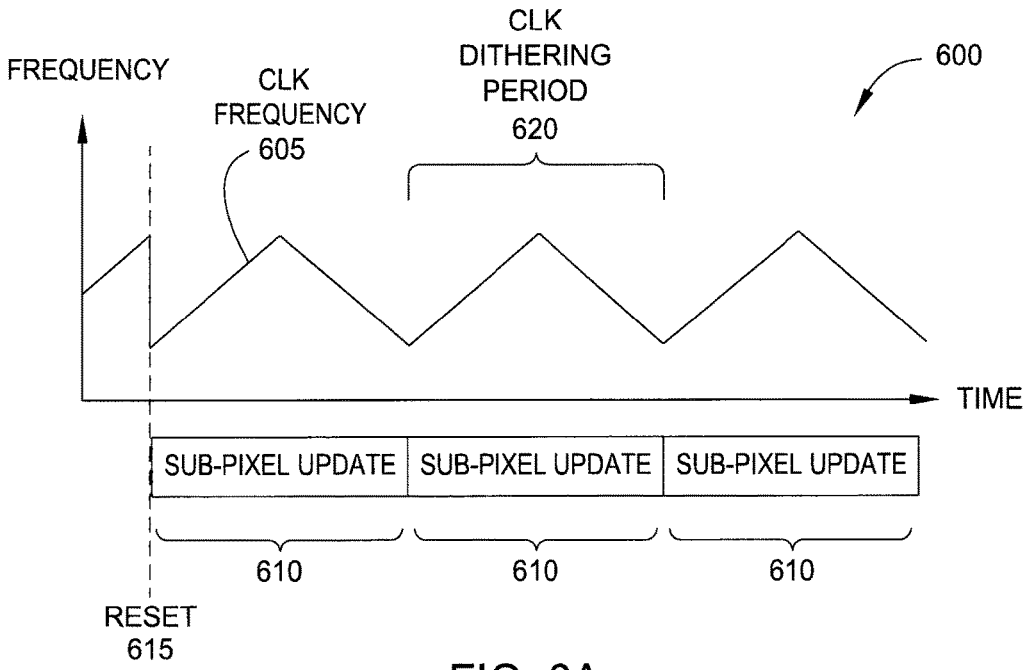
FIGS. 6A and 6B illustrated synchronizing clock dithering with a pixel refresh period in accordance embodiments of the invention.

FIG. 6A is a chart 600 illustrating synchronizing a clock frequency 605 with a sub-pixel update period 610 in accordance with an embodiment of the invention. Like in FIG. 5, the sub-pixel update periods 610 represent the length of time a sub-pixel in a particular row in the display is updated (e.g., the time used to update all the red sub-pixels in a row or the time used to update all the green sub-pixels in a row). In another embodiment, the sub-pixel update period 610 may be a display line update rate (assuming that all the sub-pixels in a selected row can be updated in parallel).

As shown, the CLK frequency 605 has the same value at the beginning and end of each of the sub-pixel update periods 610. That is, dithering the CLK frequency 605 is synchronized with the sub-pixel update periods 610 so that a CLK dithering period 620 (i.e., a complete cycle of a dithering pattern) has the same duration as the sub-pixel update periods 610. Thus, in this embodiment, the dithering period 620 has one-to-one relationship with the sub-pixel update periods 610. As a result, unlike in FIG. 5 where the CLK frequency 505 is reset at the beginning of each sub-pixel update period, here the CLK frequency 605 does not need to be reset between the update periods 610 since the CLK dithering period 620 is the same duration as the sub-pixel update periods 610.

Although in this example the CLK dithering period 620 and the sub-pixel update periods 610 are the same duration, the display device may nonetheless reset the CLK frequency 605 during certain events. For example, a reset 615 may be used at the beginning of a display frame so that the CLK frequency 605 begins at the correct value of the dithering pattern shown in FIG. 6A for the first sub-pixel update period 610 in the frame. In another example, the reset 615 may be performed after blanking periods (e.g., long blanking periods that are between display line updates in a frame and are at least as long as a display line update) where capacitive sensing is performed in the display frame. Put differently, because some blanking periods may not be synchronized with the CLK dithering period 620, once these blanking periods are complete, the display device performs the reset 615 so that the dithering of the CLK frequency 605 and the sub-pixel update periods 610 are aligned as shown in FIG. 6A.

Figure 6B:
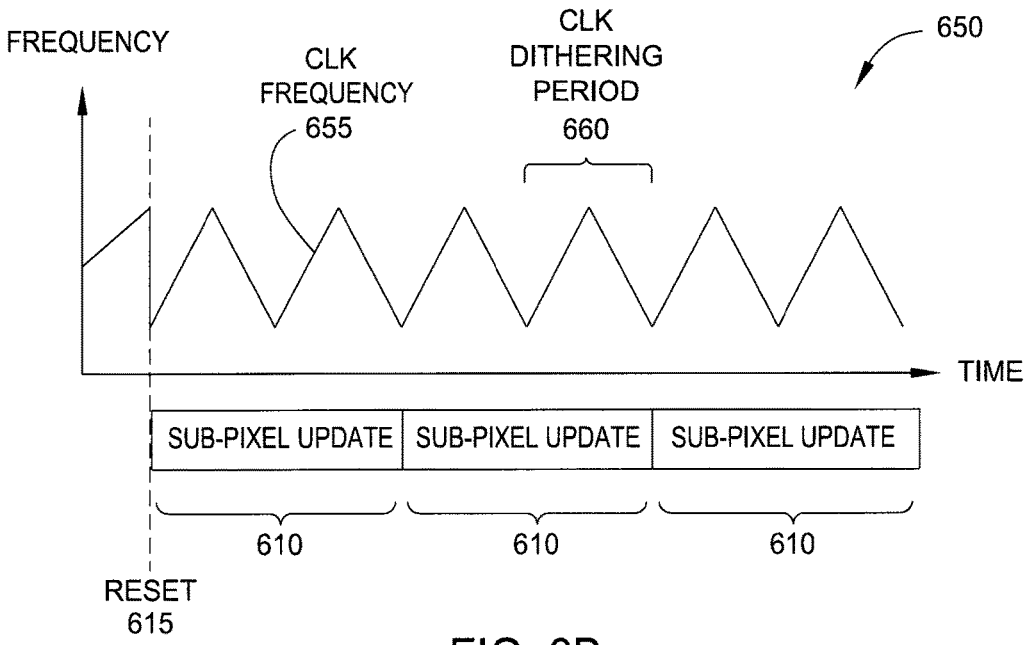

FIG. 6B illustrates a chart 650 where the sub-pixel update period 610 is an integer multiple of a CLK dithering period 660 of the CLK frequency 655. Stated oppositely, the CLK frequency 655 is an integer multiple of the frequency of the sub-pixel update rate (or the display line update rate if the sub-pixels are updated in parallel). In this example, the CLK dithering period 660 is half as long as the sub-pixel update periods 610 such that two complete dithering cycles of the CLK frequency 655 can be completed during one sub-pixel update period 610. Of course, in other examples, the CLK frequency 655 may perform three or four dithering cycles during a single sub-pixel update period 610.

Like in FIG. 6A, the CLK frequency 655 can reset in response to certain events such as a beginning of a display frame or the end of a blanking period within the display frame. Moreover, the number of CLK dithering periods 660 within a sub-pixel update period 610 may change dynamically. For example, the device may switch to a low power mode where the duration of each sub-pixel update period 610 is increased (i.e., the display device is refreshed less frequently). Nonetheless, the display device can synchronize the dithering of the CLK frequency to the new sub-pixel update period 610. For example, instead of having two CLK dithering periods 655 in a single update period 610, the display device may have three dithering periods 655 in each period 610.

Synchronizing the dithering of the CLK frequency to the sub-pixel update periods as shown in FIGS. 6A and 6B achieves the same advantages as described above. Because each sub-pixel update' period 610 (or display line update) is an integer multiple of the dithering period of the CLK frequency, the total duration of each of the periods 610 is the same, and thus, the described dithering does not artificially cause two sub-pixels that should be the same illumination to have different intensities, or sub-pixels in different rows to have different illumination values when they should be the same.

Figure 7A:
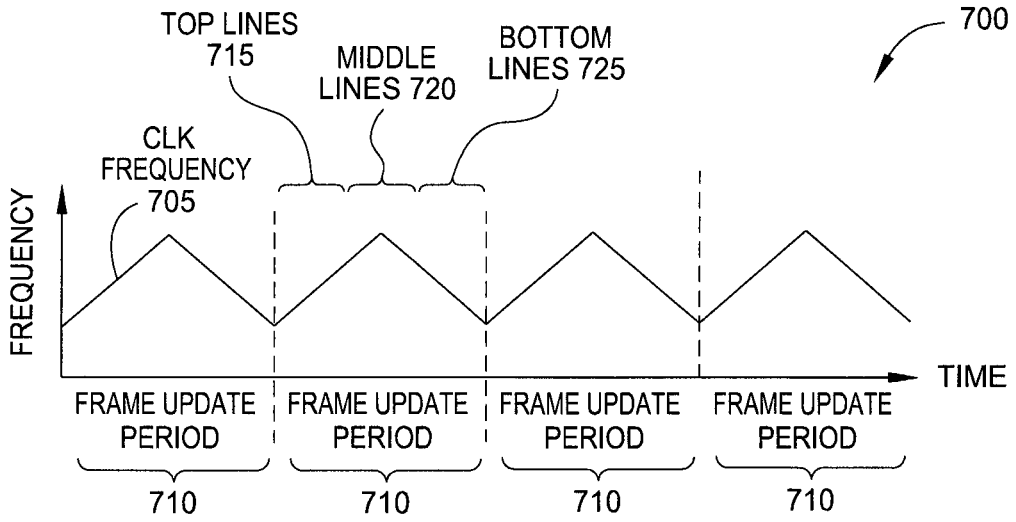
FIGS. 7A and 7B illustrate synchronizing clock dithering with a frame update period in accordance with an embodiment of the invention.
Figure 7B:
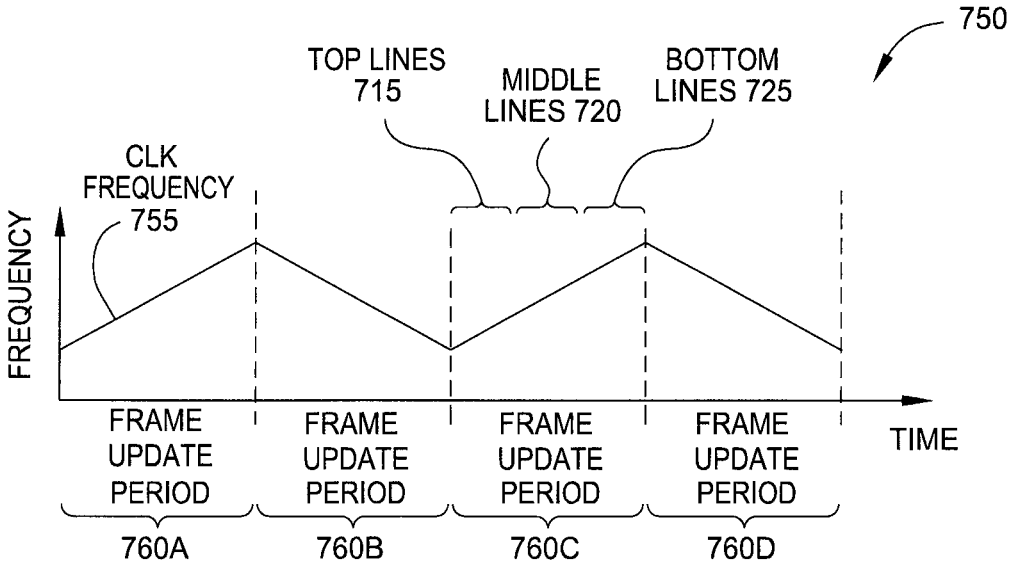

FIGS. 7A and 7B illustrate synchronizing dithering with a frame update period in accordance with an embodiment of the invention. In FIG. 7A, the clock generator dithers the frequency of the CLK such that the frequency 705 changes in the same manner during each frame update period 710. As shown, at the beginning of each frame update period 710, the CLK frequency 705 is reset to a predetermined frequency. In this example, the CLK frequency 705 starts at a low frequency at the beginning of the frame update periods 710, rises to a high frequency in the middle of the periods 710 before returning to the same low frequency at the end of the period 710.

FIG. 7A also illustrates portions in the frame update period 710 where the top lines 715, middle lines 720, and bottom lines 725 in the display device are updated. For simplicity, it is assumed that the display device is updated from the top lines down to the bottom lines. However, the order at which the display lines are updated does not matter so long as the same order is followed during each frame update period 710. In this example, the CLK frequency 705 is the same for each line update in the frame update periods. Stated differently, the same CLK frequency 705 is used when updating the lines of the display regardless of the particular frame being updated. Thus, a display line in one frame does not have a different brightness than the same display line in a different frame since the CLK frequency 705 is the same. For example, if the pixels in a display line do not change between different frames, then the brightness of those pixels remains constant.

FIG. 7B illustrates a display scheme where the CLK frequency 755 does not follow the same pattern for each frame update period 760. Unlike in FIG. 7A where the CLK frequency 705 changes in the same manner during the periods 710, here, the CLK frequency 755 changes in a different manner. For example, in the frame update periods 760A and 760C, the CLK frequency 755 ramps from a low frequency to a high frequency, but during frame update periods 760B and 760D, the CLK frequency 755 ramps from a high frequency to a low frequency. At the beginning of each frame update period 760, the clock generator resets the CLK frequency 755 to a predetermined frequency, but this frequency is different for frame update periods 760A/C and periods 760B/D. In this example, the clock generator sets the CLK frequency 755 at the beginning of frame update period 760A to a first predetermined (lower) frequency and the CLK frequency 755 at the beginning of frame update period 760B to a second predetermined (higher) frequency.

Although the duration of the individual display update times in periods 760A and 760C and in periods 760B and 760D are the same, the display line update times in period 760A can be different than the display line update times in period 760B. For example, when updating the top lines 715 during frame update period 760A, the CLK frequency 755 is slower than when updating the top lines 715 during period 760B. As a result, the display line update periods are longer for the top lines 715 during period 760A than during period 760B. Thus, even if the pixels in the top lines 715 should be the same for the different frames (i.e., the pixel data does not change), the brightness can vary.

However, any change of brightness caused by the changing pattern of clock dithering is not perceptible to the viewer. For example, assuming the pixel data does not change between the frames, the top lines 715 updated during frame update periods 760A and 760C are brighter than the top lines 715 updated during frame update periods 760B and 760D due to the slower CLK frequency 755. However, the frame update periods 760 are short enough (e.g., a frame update rate is greater than 20 Hz) so that the frames are not individually perceivable to the user. As such, the viewer averages the different brightness of the display lines. That is, the brightness of the top lines 715 is an average of the frame update periods 760A and 760B. Because the average brightness of each of the display lines when the frames are considered as a whole does not vary, the user does not perceive any unintentional change in brightness caused by dithering the CLK frequency 755.

The specific pattern of dithering the CLK frequency 755 does not matter so long as the average brightness of a display line does not vary over multiple frames. For example, during frame update period 760A, the CLK frequency 755 may follow the same pattern as the CLK frequency 705 in FIG. 7A where the frequency varies from a low frequency, to a high frequency, and back to a low frequency. However, during frame update period 760B, the CLK frequency 755 may follow the inverse pattern and vary from a high frequency, to a low frequency, and back to a high frequency. So long as the duration of the frame update periods causes the user to average the brightness of the individual display lines, the user perceives a constant brightness in the display lines (e.g., no flickering). In this manner, the display device can perform dithering while preventing display artifacts such as flickering lines or rows in the display, non-uniform brightness of display lines, or color shifts in displayed pixels.

Figure 8:
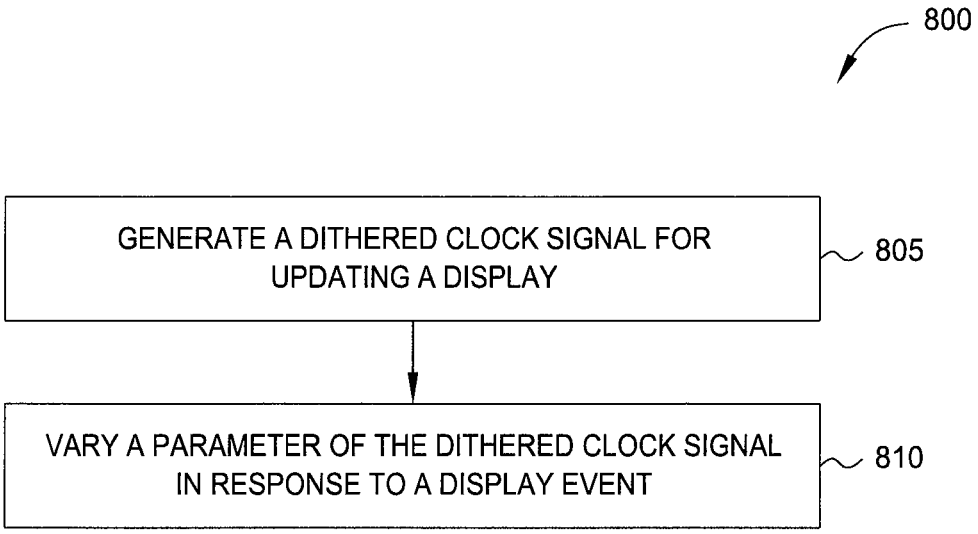
FIG. 8 is a flow chart illustrating a method 800 for preventing display artifacts when dithering a clock signal in accordance with an embodiment of the invention.

FIG. 8 is a flow chart illustrating a method 800 for preventing display artifacts when dithering a clock signal in accordance with an embodiment of the invention. At block 805, the clock generator generates a dithered clock signal for updating a display. As described above, the dithering clock signal changes the frequency of the clock signal over time such that the frequency spectrum of the signal increases which can minimize interference with other components or systems in a display device.

At block 810, the clock generator varies a parameter of the dithered clock signal in response to a display event. In one embodiment, the parameter of the dithered clock signal is the frequency of the clock signal or a parameter that controls the frequency of the clock signal (e.g., dither signal 210 in FIG. 2B). The display event can include switching between display line updates (as shown in FIG. 5), switching between frame updates (as shown in FIGS. 7A and 7B), or changing a display frequency (as shown in FIG. 6). In response to the display event, the clock generator varies the frequency of the clock signal. In one embodiment, doing so synchronizes the dithered clock frequency to the display event—e.g., a display line update or a frame update.

In one embodiment, the clock generator varies the frequency of the clock signal such that the pattern in which the frequency changes is the same for each display event as shown in FIGS. 5 and 7A. In another embodiment, the clock generator varies the frequency of the clock signal such that the average frequency of the dithered clock signal during a plurality of display events in single display frame or over multiple display frames is the same.

The embodiments and examples set forth herein were presented in order to best explain the embodiments in accordance with the present technology and its particular application and to thereby enable those skilled in the art to make and use the present technology. However, those skilled in the art will recognize that the foregoing description and examples have been presented for the purposes of illustration and example only. The description as set forth is not intended to be exhaustive or to limit the disclosure to the precise form disclosed.

In view of the foregoing, the scope of the present disclosure is determined by the claims that follow.

I claim:

1. A processing system for a display device, the processing system comprising:

a clock generator configured to generate a clock signal using clock dithering for updating a display of the display device during a plurality of display events, wherein the processing system is configured to vary a parameter of the clock dithering performed on the clock signal in response to the plurality of display events, wherein a frequency of the clock signal is gradually changed between a high value and a low value during each of the plurality of display events.

2. The processing system of claim 1, wherein the display events are display line updates, and wherein varying the parameter comprises resetting the frequency of the clock signal to a pre-determined value at a beginning of the display line updates.

3. The processing system of claim 2, wherein varying the parameter of the clock dithering comprises:

setting the frequency of the clock signal to an integer multiple of a display frequency used when performing the display line updates in the display device.

4. The processing system of claim 1, wherein the display events are sub-pixel update periods, wherein varying the parameter of the clock dithering comprises:

setting the frequency of the clock signal to an integer multiple of a display frequency used when updating sub-pixel colors during the sub-pixel update periods.

5. The processing system of claim 1, wherein the display events are frame update periods, wherein varying the parameter of the clock dithering comprises:

resetting the frequency of the clock signal to a predetermined frequency during a beginning of the frame update periods.

6. The processing system of claim 5, wherein the frequency of the clock signal is reset to the predetermined frequency at the beginning of a plurality of sequential frame update periods.

7. The processing system of claim 5, wherein the frequency of the clock signal is reset to different predetermined frequencies at the beginning of two sequential frame update periods.

8. The processing system of claim 1, wherein an average frequency of the clock signal during each of the plurality of display events is the same.

9. An input device, comprising:

a display comprising a plurality of display lines; and a processing system coupled to the display, the processing system comprising a clock generator configured to generate a clock signal using clock dithering for updating the display during a plurality of display events, wherein the processing system is configured to vary a parameter of the clock dithering performed on the clock signal in response to the plurality of display events, wherein a frequency of the clock signal is gradually changed between a high value and a low value during each of the plurality of display events.

10. The input device of claim 9, wherein the display events are display line updates, and wherein varying the parameter comprises resetting the frequency of the clock signal to a pre-determined value at a beginning of the display line updates.

11. The input device of claim 10, wherein varying the parameter of the clock dithering comprises:

setting the frequency of the clock signal to an integer multiple of a display frequency used when performing the display line updates.

12. The input device of claim 9, wherein the display events are sub-pixel update periods, wherein varying the parameter of the clock dithering comprises:

setting the frequency of the clock signal to an integer multiple of a display frequency used when updating sub-pixel colors during the sub-pixel update periods.

13. The input device of claim 9, wherein the display events are frame update periods, wherein varying the parameter of the clock dithering comprises:

resetting the frequency of the clock signal to a predetermined frequency during a beginning of the frame update periods, wherein the frequency of the clock signal is reset to the predetermined frequency at the beginning of a plurality of sequential frame update periods.

14. The input device of claim 9, wherein varying the parameter of the clock dithering comprises:

resetting the frequency of the clock signal to a first predetermined frequency during a beginning of a first frame update period; and resetting the frequency of the clock signal to a second predetermined frequency during a beginning of a second frame update period, wherein the first predetermined frequency is different from the second predetermined frequency and the second frame update period sequentially follows the first frame update period.

15. A method of operating a display device, the method comprising:

generating a dithered clock signal used for updating a display in the display device during a plurality of display events; and varying a parameter of the dithered clock signal in response to the plurality of display events, wherein a frequency of the dithered clock signal is gradually changed between a high value and a low value during each of the plurality of display events.

16. The method of claim 15, wherein the display events are display line updates and varying the parameter further comprises:

resetting the frequency of the dithered clock signal to a pre-determined value at a beginning of the display line updates.

17. The method of claim 16, wherein varying the parameter of the clock dithering signal comprises:

setting the frequency of the dithered clock signal to an integer multiple of a display frequency used when performing the display line updates in the display device.

18. The method of claim 15, wherein the display events are sub-pixel update periods, wherein varying the parameter of the clock dithering signal comprises:

setting the frequency of the dithered clock signal to an integer multiple of a display frequency used when updating sub-pixel colors during the sub-pixel update periods.

19. The method of claim 15, wherein the display events are frame update periods, wherein varying the parameter of the clock dithering signal comprises:

resetting the frequency of the dithered clock signal to a predetermined frequency during a beginning of the frame update periods, wherein the frequency of the dithered clock signal is reset to the predetermined frequency at the beginning of a plurality of sequential frame update periods.

20. The method of claim 15, wherein varying the parameter of the clock dithering signal comprises:

resetting the frequency of the dithered clock signal to a first predetermined frequency during a beginning of a first frame update period; and resetting the frequency of the dithered clock signal to a second predetermined frequency during a beginning of a second frame update period, wherein the first predetermined frequency is different from the second predetermined frequency and the second frame update period sequentially follows the first frame update period.

* * * * *